US006747617B1

(12) United States Patent
Kawashima

(10) Patent No.: US 6,747,617 B1
(45) Date of Patent: Jun. 8, 2004

(54) DRIVE CIRCUIT FOR AN ORGANIC EL APPARATUS

(75) Inventor: Shingo Kawashima, Tokyo (JP)

(73) Assignee: NEC Corporation, Tokyo (JP)

( * ) Notice: Subject to any disclaimer, the term of this patent is extended or adjusted under 35 U.S.C. 154(b) by 21 days.

(21) Appl. No.: 09/714,300

(22) Filed: Nov. 16, 2000

(30) Foreign Application Priority Data

Nov. 18, 1999 (JP) ..... 11-328657

(51) Int. Cl.[7] ..... G09G 3/30

(52) U.S. Cl. ..... 345/76; 345/77; 345/82; 345/83; 345/211; 345/212; 345/213; 345/589; 345/600; 315/169.1; 315/169.3

(58) Field of Search ..... 345/76, 77, 82, 345/83, 211, 212, 213, 589, 600; 315/169.1, 169.3

(56) References Cited

U.S. PATENT DOCUMENTS 5,812,105 A * 9/1998 Van de Ven ..... 345/83
5,828,362 A * 10/1998 Takahashi et al. ..... 345/153
5,949,194 A * 9/1999 Kawakami et al. ..... 315/169.4
6,144,352 A * 11/2000 Matsuda et al. ..... 345/83
6,184,850 B1 * 2/2001 Suzuki et al. ..... 345/74
6,229,505 B1 * 5/2001 Fujii ..... 345/76
6,281,634 B1 * 8/2001 Yokoyama ..... 315/169.3
6,369,786 B1 * 4/2002 Suzuki ..... 345/77
6,369,791 B1 * 4/2002 Kudo et al. ..... 345/100
6,429,837 B1 * 8/2002 Ishizuka et al. ..... 345/74.1
6,486,601 B1 * 11/2002 Sakai et al. ..... 313/504
6,545,651 B2 * 4/2003 Nishigaki et al. ..... 345/76

FOREIGN PATENT DOCUMENTS

JP 05-273936 * 10/1993 ..... G09G/3/28
JP 06-208342 7/1994
JP 8-211832 8/1996
JP 10-063228 3/1998
JP 10-112391 4/1998
JP 11-305729 11/1999
JP 2000-056732 2/2000
JP 2000-098919 4/2000
JP 2000-242208 9/2000

* cited by examiner

*Primary Examiner*—Richard Hjerpe
*Assistant Examiner*—Jennifer T. Nguyen
(74) *Attorney, Agent, or Firm*—Katten Muchin Zavis Roseman

(57) ABSTRACT

In drive circuit for organic EL elements performing multi-color light emission, DC power supply circuits 21,22 and 23 are provided for each emitted color of light, so as to supply a voltage that differs, depending upon the color of light emitted, thereby reducing the amount of power loss that occurred in the current drive circuit 31,32 and 33 because of the differences in the voltage versus intensity characteristics of each emitted color EL elements.

4 Claims, 7 Drawing Sheets

DRIVE CIRCUIT FOR AN ORGANIC EL APPARATUS

FIELD OF THE INVENTION

The present invention relates to a drive circuit for an organic electroluminescence (EL) apparatus, and more particularly to a color organic EL display apparatus so as to achieve low power consumption.

RELATED ART

An electroluminescence (EL) display apparatus is a type of thin display apparatus, in which a thin light-emitting film is applied to a glass substrate, wherein a high voltage is applied via a transparent electrode so as to cause emission of light. Being self-emitting and featuring superior readability and response speed, the EL display ranks with LCD displays in terms of expectations for the future. However, there is a remaining problem with EL displays in achieving low cost, and EL elements are used at present in backlighting applications for such devices as LCD displays, making use of their characteristic of emitting a bright light with a low power consumption.

One disclosed example with regard to a drive method for use in the case in which an organic EL element is used as a backlight for an LCD display or the like, is that in Japanese Unexamined Patent Publication (KOKAI) No.8-211832. In this disclosure, although there is high light-emitting efficiency and an organic EL element at a low voltage, as long as this is used as a backlight, the amount of power consumed is large. Because of this, in the subject disclosure, the configuration is one in which an organic EL element capable of a pattern display is applied, the same image being caused to be displayed on both the LCD element part and the organic EL display element part, the drive electrode pattern being substantially the same, so as to make use of both low power consumption and high light-emitting efficiency.

In this disclosure, the construction is such that the pixels of the organic EL display element part are cause to coincide with the pixels of the LCD display element part, there being a lamination of a substrate, a transparent electrode serving as an anode, a hole injection layer, an organic EL emitting layer and an electrode which serves as both a cathode and a reflector ,from the bottom surface of the polarizer of the upper LCD display element part. In this disclosure, a circuit shown in FIG. 8 is used as a drive circuit for the organic EL display element part.

As shown in FIG. 8, the drive circuit in the color display of an organic EL of the past, supplies current to the elements for each color from a single power supply line, regardless of the color of the light emitted. In FIG. 8, the configuration is one that has the current control section 11 for Blue pixels, the current control section 12 for Green pixels, and the current control section 13 for Red pixels of the color organic EL display, the current drive circuits 31, 32, and 33 which control the current values of the control signal Ib,Ig,Ir, respectively, organic EL elements 41(B), 42(G), and 43(R) serving as backlights and driven by the current drive circuits 31 to 33, and a DC power supply Vdd 51.

A constant voltage is supplied to the organic EL elements 41(B), 42(G), 43(R) from the DC power supply Vdd 51, and the current drive circuits 31, 32, and 33, the current values thereof are controlled in response to an image signal, cause light emission from the organic EL elements 41, 42, and 43. Therefore, in addition to causing emission of light from the organic EL elements 41(B), 42(G), and 43 (R) with a different current value for each of the current drive circuits 31 to 33, each of the same pixels are simultaneously displayed as well on the LCD element parts (not shown in the drawing), so that it is possible to attain a display with both low power consumption and superior read ability.

However, the same voltage is applied to each current drive circuit. Because of this, in an organic EL having voltage versus intensity characteristics as shown in FIG. 2, for a drive circuit of a green (G) element that can be driven with a small applied voltage, the voltage difference between the voltage required for drive and the power supply voltage does not contribute to emission of light. On the other hand, a drive circuit for a blue (B) element requires high voltage, the high voltage is applied.

Therefore, in a drive circuit for an organic EL element of the past, it is necessary to set the applied voltage to suit the element for the color that requires the largest voltage, so that in a drive circuit for an element achieving the required intensity at a low voltage, there was the problem that the power consumption of the drive circuit was large.

Accordingly, it is an object of the present invention to achieve low power consumption in an organic EL color display apparatus, and to further improve the overall drive efficiency.

SUMMARY OF THE INVENTION

To achieve the above-noted object, the present invention has the following basic technical constitution.

Specially, the first aspect of the present invention is a drive circuit for an organic EL apparatus having a plurality of organic EL elements performing multicolor light emission, comprising a plurality of DC power supply circuits for each one of colors of emitted lights from the respective organic EL elements, wherein a voltage from one of the DC power supply circuits is applied to one of the organic EL elements emitting one of colors of lights, which is different from the voltage, applied to other organic EL elements emitting respective colored light therefrom.

In the second aspect of the present invention, the DC power supply circuit is a DC-DC converter, and a current drive circuit connected to an output of the DC-DC converter so as to drive the EL elements, is provided, and this current drive circuit is controlled by a control signal responsive to a color signal obtained from an image to be displayed, and drives the organic EL elements.

In the third aspect of the present invention, a power supply voltage controller controlling the DC-DC converter in accordance with a differential voltage between an input voltage of the current drive circuit and an output voltage of the current drive circuit, is provided.

In the fourth aspect of the present invention, the current drive circuit is controlled by a current control section, this current control section having a first circuit detecting differential potential between an output voltage of the DC-DC converter and an output voltage of the current drive circuit, and a second circuit outputting control signal to the current drive circuit in accordance with a voltage detected by the first circuit.

In the fifth aspect of the present invention, the current drive circuit is controlled by a current control section, this current control section comprising a first circuit detecting differential potential between an output voltage of the DC-DC converter and an output voltage of the current drive circuit, and a second circuit comparing the detected differential potential by the first circuit with a reference voltage, and a third circuit outputting control signal to the current drive circuit based on comparison result of the second circuit.

DETAILED DESCRIPTION OF THE PREFERRED EMBODIMENTS (First Embodiment)

FIG. 1 to FIG. 5 show a first embodiment of the present invention.

In this embodiment, the configuration is one in which a DC-DC converter for supplying a voltage for each individual organic EL color elements (R, G, and B) is provided, the supply voltages set for each individual color elements being supplied via power supply lines for each individual color.

Figure 1:
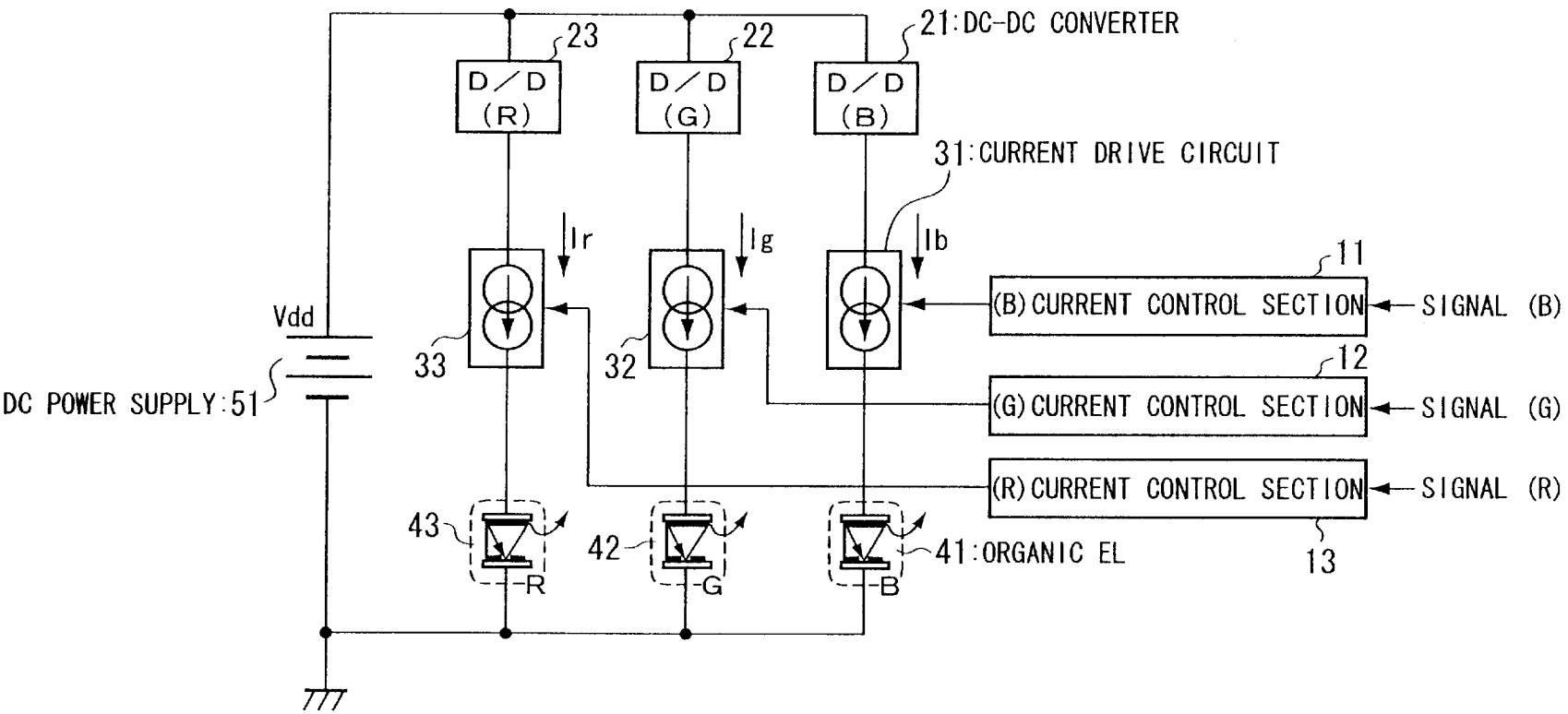
FIG. 1 is block diagram of an organic EL color display apparatus according to a first embodiment of the present invention.

FIG. 1 shows the circuit diagram of the drive circuit for an organic EL display element according to the first embodiment. In this drawing, reference numerals 11 to 13 denote current control sections which output control signals responsive to each color signal of an image signal, and each current control section outputs current Ib, Ig, Ir in response to each current drive circuit, respectively. The reference numerals 21 to 23 denote DC-DC converters for each individual color elements, which output a DC voltage converted to a power supply voltage for each individual color elements. The reference numerals 31 to 33 denote current drive circuits for each color display (RGB), the current values of which are controlled by control signals of current control sections, and current drive circuits 31, 32, 33 drive the organic EL elements (RGB), respectively. The reference numerals 41 to 43 are organic EL elements, these being separated into three divisions for each color, each division being separately driven so as to control amount of emitted light responsive to a drive current and a drive voltage. The reference numeral 51 denotes a DC power supply having a voltage of vdd.

Figure 5:
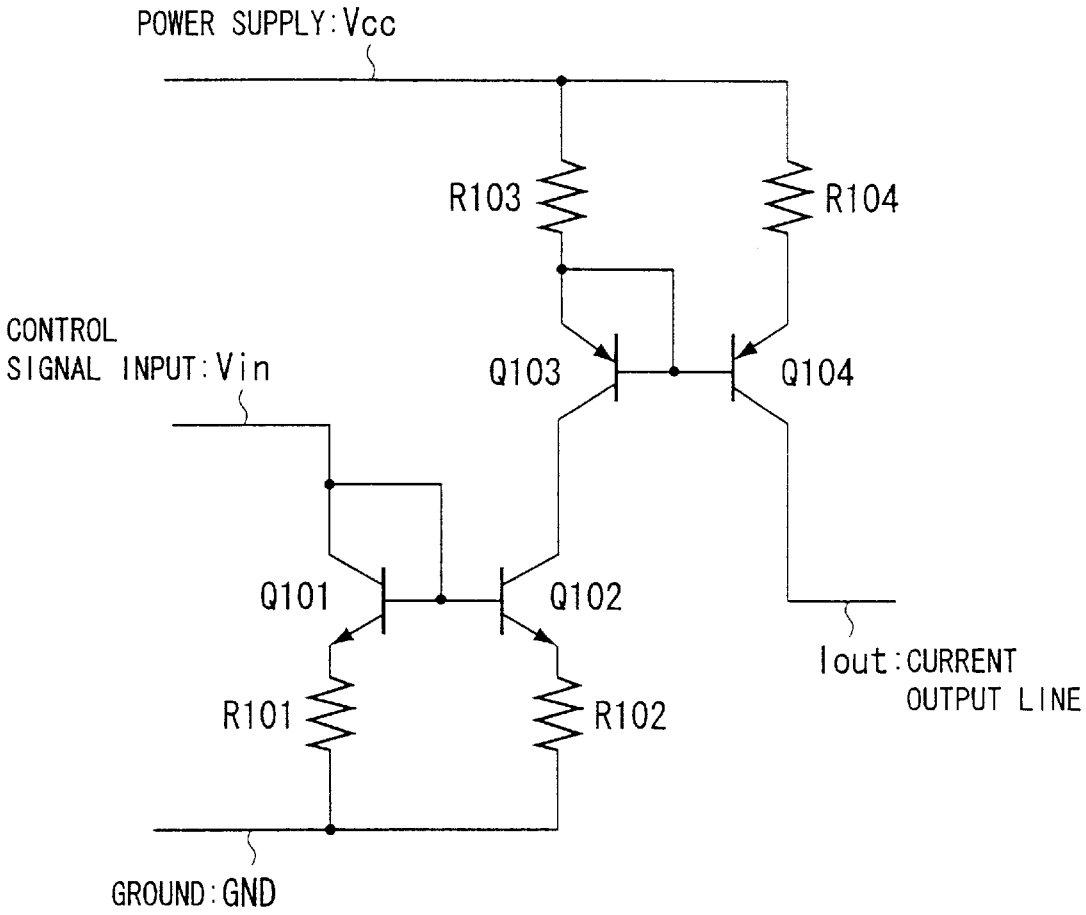
FIG. 5 is a detailed circuit diagram of a current drive circuit used in the present invention.

FIG. 5 shows a specific circuit diagram of the current drive circuits 31 to 33. The first current mirror circuit is formed by the NPN transistors Q101 and Q102 and the resistances R101 and R102, and the second current mirror circuit is formed by the PNP transistors Q103 and Q104 and the resistances R103 and R104, the transistors Q103 and Q102 being connected in series, a current responsive to the control signal Vin output from the current control section 11 to 13 being generated by the mirror effect in the transistor Q102 and the second current mirror circuit generating the same current in transistor Q104. The power supply of the second current mirror is supplied from the DC-DC converters 21 to 23 for each individual color, and the emitter of transistor Q104 is connected to each of the organic EL elements for each color, a current control section outputs Iout only in response to the control signal Vin. In this circuit, outout Iout does not change in response to the power supply voltage. Therefore, the organic EL display emits light only in response to the controlled current Iout.

The operation of this embodiment of the present invention is described below, making reference to FIG. 1.

In order to achieve the appropriate intensity for elements of organic EL elements R, G, and B having different colors, the drive circuits 31, 32 and 33 are connected to each organic EL elements R, G, and B. The value of output lout responsive to each color is set based on the current value as shown in FIG. 5, and the output lout is controlled in response to the output signal from current control section.

The outputs of DC-DC converters 21, 22 and 23 are connected to the inputs of the current drive circuits 31, 32 and 33, respectively.

As shown in FIG. 5, the current drive circuits 31, 32 and 33 receive a control signal from the current control sections 31, 32 and 33, respectively, and a first current mirror circuit formed by the transistors Q101 and Q102 and resistances R101 and R102 and a second current mirror circuit formed by transistor Q103 and Q104 and resistances R103 and R104 output a current Iout, a current value of which is not influenced by the power supply voltage, so that a light intensity of the organic EL elements is only responsive to the current Iout.

Figure 2:
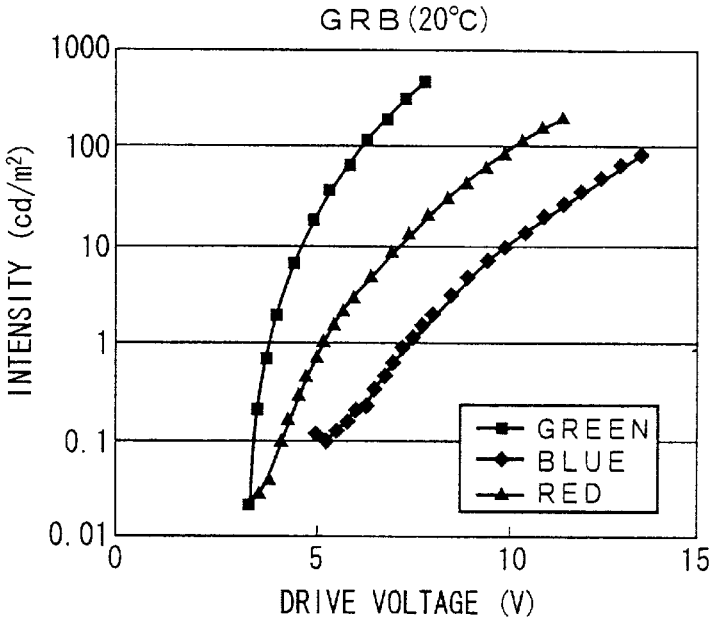
FIG. 2 is a voltage versus intensity characteristics graph of an organic EL element according to the present invention.

In the current drive circuits 31 to 33 configured as shown in FIG. 5, whereas the constant current output that is not influenced by the voltage is obtained, the power consumption in this circuit is the simple product of the applied voltage, that is, the power supply voltage Vcc, and the current flowing. Because of this, in order to reduce the power consumption in the current drive circuits 31 to 33, it is necessary to establish the voltage difference between the output terminal voltage of the current drive circuit and the power supply voltage of the current drive circuit as a low value. As shown in FIG. 2, dependent upon the characteristics of the organic EL, there will be a large difference in the voltage that needs be applied to achieve a uniform intensity between the various emitted colors. Therefore, the voltage that must be supplied to the current drive circuit 31 to 33 in order to achieve the required intensities differs greatly, depending upon the color of the light emitted.

In the case in which the same supply voltage is supplied to the current drive circuit for each color, in the above-described case of FIG. 2, it becomes necessary to provide the supply of a voltage required for the current drive circuit 31 for the blue organic EL, so that in order to obtain the same intensity, the voltage supplied to the current drive circuit 32 for the green organic EL 42 is excessively high, thereby resulting in an increase in the power consumption at the current drive circuit 32, to which the unnecessary high voltage is applied. To reduce this unwanted loss, the DC-DC converters 21 to 23 are provided between the power supply lines for the current drive circuit 31 to 33 for each color and the DC power supply 51, so that, the voltage converted by DC-DC converter is supplied to the current drive circuit 31 to 33 so as to provide the minimum required voltage for each color EL elements, thereby reducing this loss.

(Second Embodiment)

A second embodiment of the present invention is described below, with references made to FIG. 4 and FIG. 6.

Figure 4:
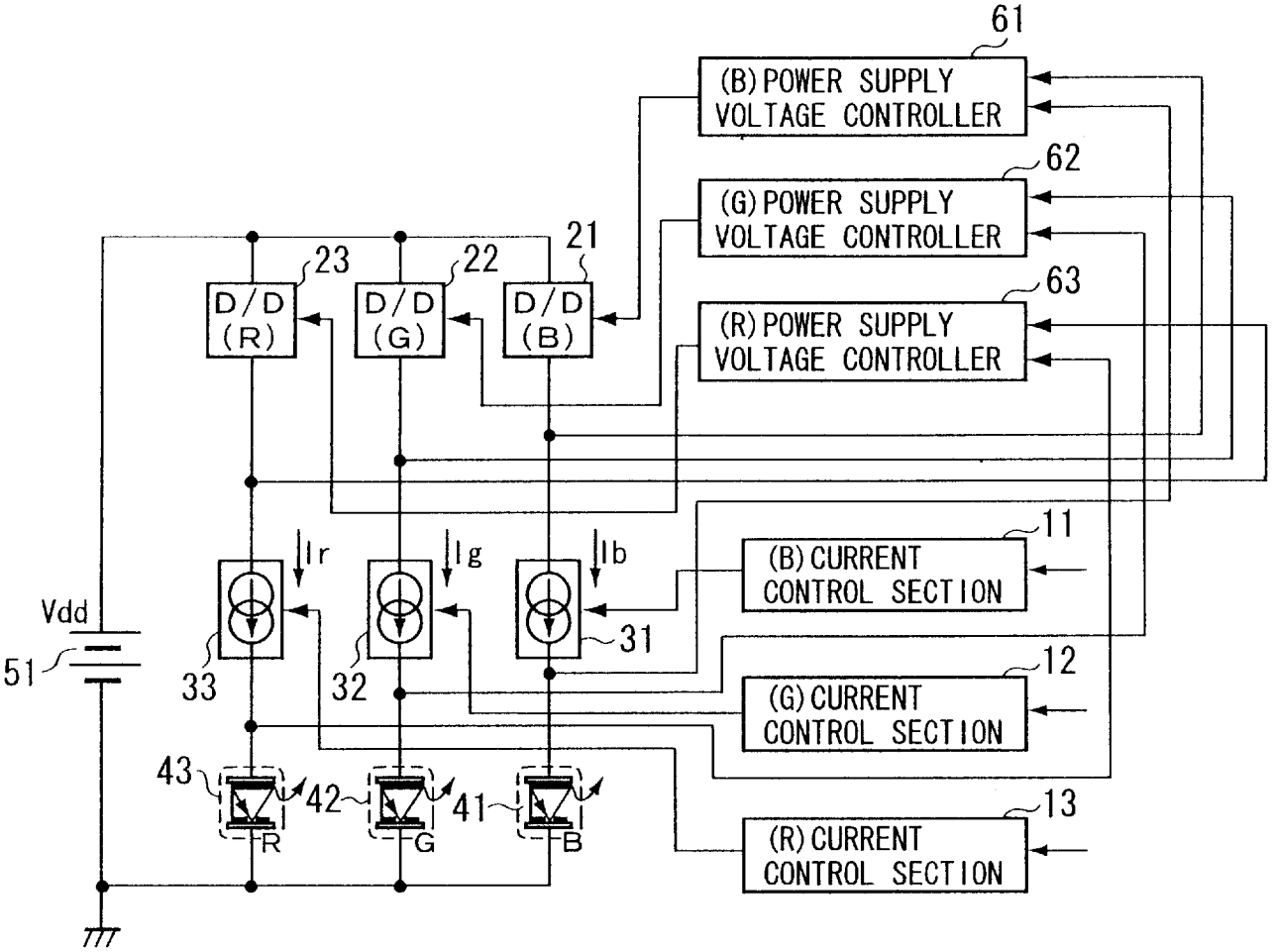
FIG. 4 is a block diagram of an organic EL color display apparatus according to a second embodiment of the present invention.

In FIG. 4, in the first embodiment of the present invention, a power supply voltage controller is provided for each DC-DC converter, thereby imparting an added function that enables adjustment of the output voltage of the DC-DC converters in real time. That is, as shown in FIG. 4, the power supply voltage control circuits 61 to 63 are provided so as to monitor the voltage differences between the output voltage of the current mirror circuit and the output voltage of the power supply 51, and the power supply voltage controllers 61 to 63 automatically control the output voltages of the DC-DC converters, thereby preventing the occurrence of excessive loss.

In FIG. 4, elements corresponding to elements in FIG. 1 are assigned the same reference numerals as in FIG. 1, reference numerals 61 to 63 denoting the power supply voltage controllers for each color, these controllers detecting the output voltages of the DC-DC converters 21 to 23 for each color and the output voltages of the current drive circuits 31 to 33 for each color, and controlling the output voltages of the DC to DC converters 21 to 23 accordingly, in response to the detected voltages.

Figure 6:
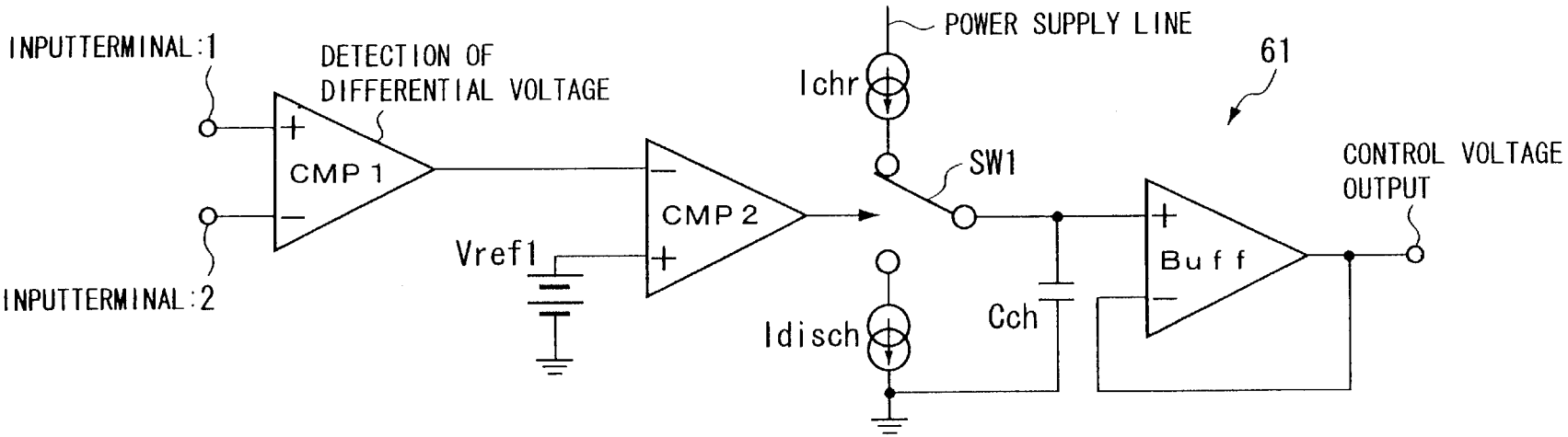
FIG. 6 is a detailed circuit diagram of a power supply voltage controller used in the present invention.

FIG. 6 shows a specific circuit diagram for each power supply voltage controller 61 to 63. In the power supply voltage controller 61, the output of the DC to DC converter 21 are input to the input terminal 1 of the operational amplifier CMP1, and the output of the current drive circuit 31 is input to the input terminal 2 of the operational amplifier CMP1. At the operational amplifier CMP1 of differential voltage detector, a detected differential voltage between the two input terminal is output. Next, the differential voltage is compared at the operational amplifier CMP2 with a reference potential Vref1. If the detected differential voltage is smaller than the reference potential Vref1, the output of the operational amplifier CMP2 sets the SW1 to the lower Idischr, and if the detected differential voltage is larger than the reference potential Vref1, the output of the operational amplifier CMP2 sets SW1 to the upper Ichr. In the prior case, if the detected differential voltage is smaller than the reference potential Vref1, the output of the buffer Buff outputs a control voltage that is a lower voltage, and controls the output voltage of the DC-DC converter as in the normal condition, thereby maintaining a constant loss in the current drive current circuit. If the detected differential voltage is larger than the reference potential Vref1, however, the output of the buffer Buff outputs a high control voltage, so that the output voltage of the DC-DC converter is greatly reduced, thereby reducing the loss in the current drive circuit.

As a result, because an excessively high power supply voltage is not supplied to the current drive circuits 31 to 33, the power consumption is reduced.

It should be noted that although in the above case feedback is performed as shown in FIG. 4, it is possible to achieve the same kind of effect by inputting the output levels of the current control sections 11 to 13 which establish the intensities of the organic EL elements, to the second input terminal of the operational amplifier CMP1 in performing power supply voltage control. For example, if the outputs of the current control section 11 to 13 are used instead of the reference potential Vref1 of FIG. 6, in accordance with the RGB image signal level, the output voltages of the DC-DC converters 21 to 23 are controlled, thereby enabling the achievement of a highly efficient drive circuit for an organic EL display apparatus.

(Third Embodiment)

Figure 7:
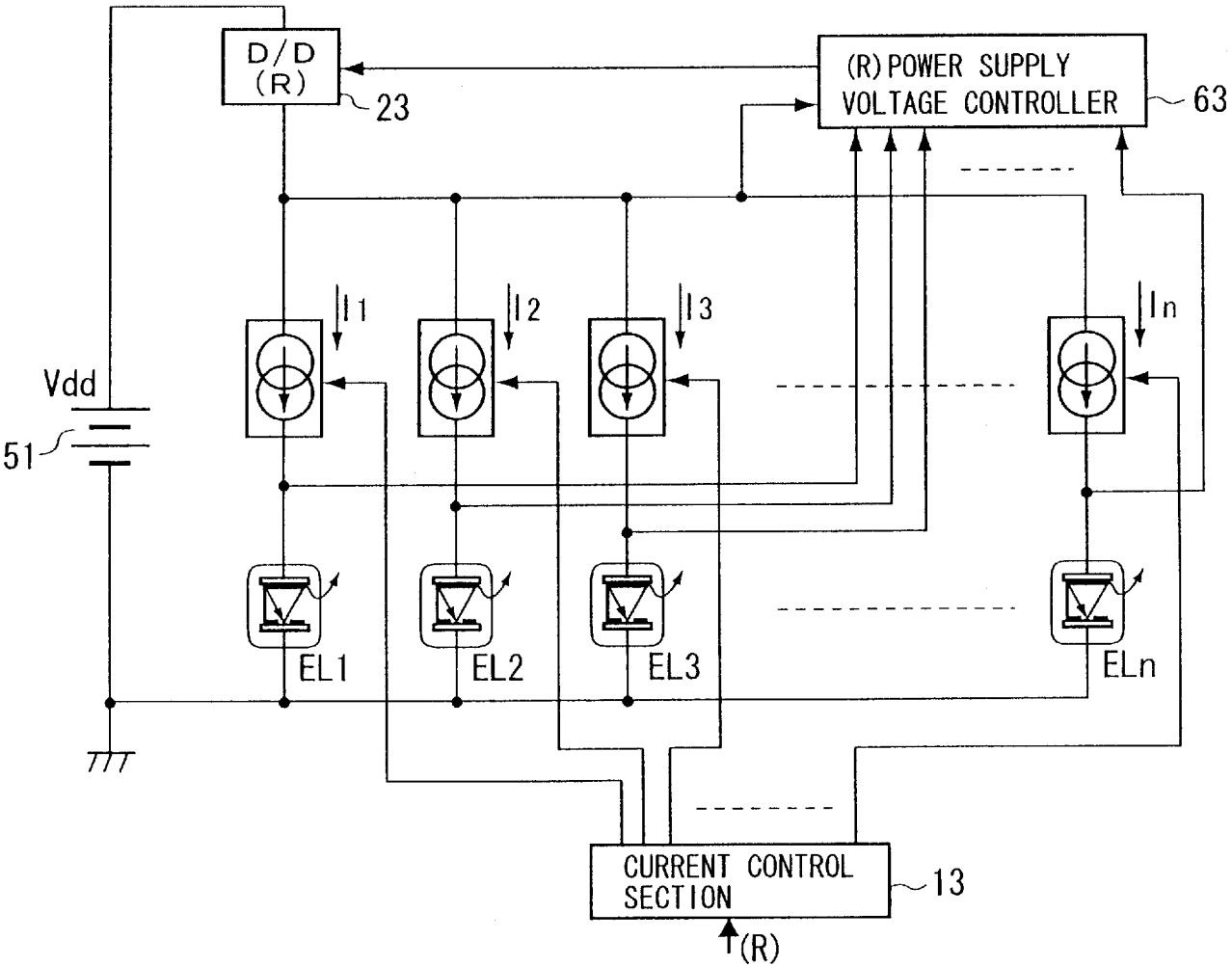
FIG. 7 is a block diagram of an organic EL color display apparatus according to a third embodiment of the present invention.
Figure 8:
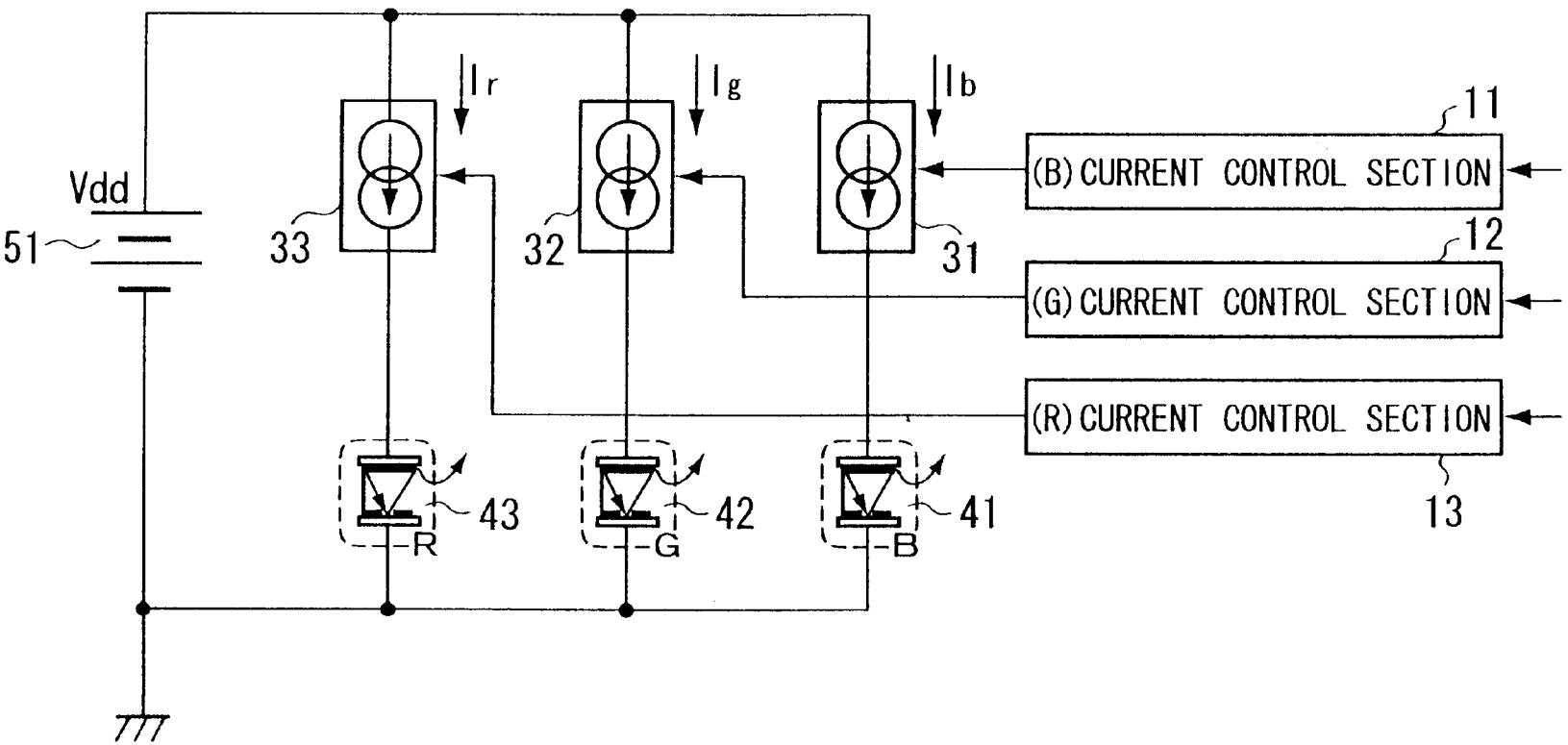
Fig. 8 PRIOR ART
FIG. 8 is a block diagram of an organic EL color display apparatus of the past.

A third embodiment of the present invention is described below, in terms of a drive circuit for a specific organic EL display element in the first and the second embodiment. A specific circuit of FIG. 1 and FIG. 4 is shown in FIG. 7. The EL elements for color red will be used as the example in FIG. 7. In this case, output current of a DC-DC converter 23 is caused to divide and flow into control current circuit I1, I2, . . . , In of the current drive circuit 33 which performs drive in accordance with a control signal from the current control section 13 that outputs a control signal in accordance with the image signal, thereby causing emission of light from the organic EL elements EL1, EL2, . . . , ELn in each row. The output voltage of the DC-DC converter 23 and the output voltages of each control circuit I1, I2, . . . In are input to the power supply voltage controller 63, as shown in FIG. 6, and the power supply voltage controller 63 controls the DC-DC converter 23 so that the losses of each control circuit I1, I2, . . . , In are made small.

In the above case, the current control section 13 controls the control drive circuits I1, I2, so that during a period in which a light is not emitted, the current control section 13 controls the current of the control drive circuit so as to be zero. That is, the current control section 13 controls each of the current drive circuits I1, I2, . . . , in responsive to the scanning time of the image signal. The power supply voltage controller 63 detects the difference between the output voltage of the DC-DC converter 23 and the output voltages output in time sequence from each of the current drive circuits I1, I2, . . . , In, and, the power supply voltage controller 63 controls the output voltage of the DC-DC converter 23, so as to make the power consumption of each current drive circuit I1, I2, . . . , In, small, in accordance with detected potential difference.

In an actual organic element EL element, because each color is formed by a plurality of lines, the configuration for each color as shown in FIG. 7 is applied to each color configuration. Therefore, one DC-DC converter 23 is connected to a plurality of current drive circuits I1 to In, and each current drive circuit drives the required number of organic EL elements or each organic EL element during the scan period of the image signal. In the first embodiment, of this configuration, the power supply voltage controller is omitted. In the descriptions that follow, based on the configuration shown in FIG. 7, only part of the configuration has been extracted and used as the example.

Figure 3:
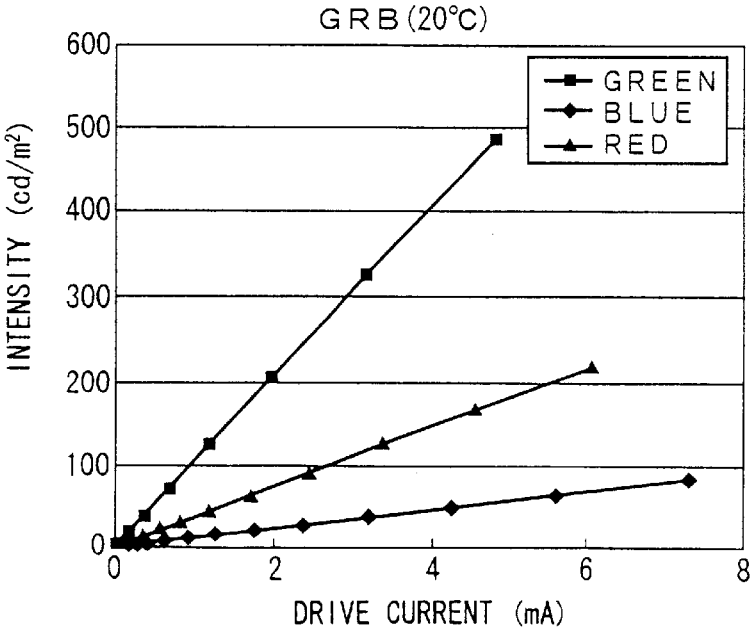
FIG. 3 is a current versus intensity characteristics graph of an organic EL element according to the present invention.

Because, as shown in FIG. 2 and FIG. 3, the voltage versus intensity characteristics and the current versus intensity characteristics of an organic EL element very greatly depending upon the color of light emitted, in a conventional current drive circuit, there was an unwanted power consumption for emission of light. To reduce this loss, voltage and current are supplied efficiently in accordance with the emitted color, thereby increasing the overall drive efficiency.

As shown in FIG. 3, in an organic EL element, there is a strong linear correlation between the drive current and the intensity of each color. In contrast to this, as shown in FIG. 2, there is a non-linear variation in the relationship between the applied voltage and the intensity, so that when attempting to provide stable control of the intensity, it is desirable to perform control of the drive current value of the EL elements.

In the case of performing control by means of a current value, and when variations between organic EL element are considered, in order to cause flow of the desired drive current and to achieve stable current-source operation, as shown in FIG. 5, it is necessary to avoid operation of the internal current mirror circuit in the saturated region, by providing sufficient power supply voltage to the current drive circuit.

In contrast to this, depending upon the color of light emitted from an organic EL element, as shown in FIG. 2, there is a large difference in voltage-to-intensity characteristic, so that in order to achieve a three-color organic EL element display with full color display capability, the voltage supplied to the organic EL elements must be doubled in order to obtain the same intensity.

In the above case, if current drive circuits such as shown in FIG. 5 and the specific example of a current drive circuit 31 to 33 are used, the potential difference between the output voltage of the DC-DC converter and the output voltage of the current drive circuit represents a power consumption in this current drive circuit, that is, the product of this potential and the output current of the current drive circuit representing a loss in the current drive circuit. To reduce this loss, it is necessary to reduce this potential difference. In order to do this, the DC-DC converters 21 to 23 are used, and the supply voltage to the current drive circuit 31 to 33 is adjusted to an appropriate level, so that the loss in the current drive circuits 31 to 33, that is, the control current circuits I1,I2, . . . , In therewithin can be reduced, thereby enabling an improvement in the overall drive efficiency.

Embodiments of the present invention are described further below. First, in terms of the first embodiment shown in FIG. 1, at the DC-DC converters 21 to 23, which are generally sufficiently adjusted, a power efficiency of 90% or greater is achieved. In the graph of FIG. 2, for the case in which drive is performed to achieve an intensity of 100 cd/m$^2$ for blue light, the applied voltage must be approximately 14 volts.

In order to achieve an equivalent intensity with green light emission, the desired intensity is achieve with approximately 6.2 volts, which is less than ½ the voltage for blue light. For this reason, in the past, the drive circuit for green light exhibited a loss corresponding to the voltage difference. That is, in this condition, the drive circuit for green light consumes approximately double the electrical power compared with the electrical power actually required for green light emission, so that the power consumption to produce light emission is only approximately 50% of the total consumed power.

If, as shown in FIG. 5, DC-DC converters 21 to 23 are provided, 90% of the power consumption is no longer consumed, so that it is possible to improve the drive efficiency for green light emission by approximately 45%.

In the same manner, for red light emission as well, to achieve the same intensity the required voltage to be applied is approximately 10 volts, so that an efficiency improvement of approximately 25% is achieved.

In the current drive circuit of a color organic EL apparatus, if the intensity level for each color is simply made the same, visual balance is lost. Because of this, rather than a controlling the drive current values to achieve constant uniform intensities for each color, control is performed so as to adjust the amount of light emitted for each color and achieve balance in accordance with the characteristics of each organic EL element and the visual perception thereof. In an actual circuit, it is possible to provide an adjustment and compensation circuit for achieving adjustment of the organic EL element intensity characteristics and image signal in the current control sectins 11 to 13.

In the above-described embodiments, while no particular mention is made of the temperature of each organic EL element, because the drive voltage versus intensity characteristics shown in FIG. 2 shift with respect to temperature, if a temperature compensation circuit that causes a change in the output control signals from the current control sections 11 to 13 responsive to the temperature characteristics is provided in each of the current control sections 11 to 13, it is possible to achieve a high-quality image display with good stable color balance even in portable transmitting/receiving equipment and mobile telephones and like. In particular, at a very low temperatures below minus 30° C. because it is possible for an organic EL element to emit light and provide a display with almost no problem, if the temperature compensation circuit is provided, it can be made highly effective.

According to the present invention, a voltage that differs for each color of light emitted being used for each current drive circuit, it being possible to achieve low-power operation and high overall drive efficiency in an organic EL color display apparatus.

What is claimed is:

1. A drive circuit for an organic EL apparatus having a plurality of organic EL elements performing multicolor light emission, comprising a plurality of DC power supply circuits for each one of colors of emitted lights from said respective organic EL elements, wherein a voltage from one of said DC power supply circuits is applied to one of said EL elements emitting one of colors of lights, which is different from the Voltage, applied to other organic EL elements emitting respective colored light therefrom, wherein each of said DC power supply circuits is a DC-DC converter, further comprising a plurality of current drive circuits, one of said plurality of current drive circuits being connected to an out put of one of said DC-DC converters so as to drive one of said EL elements, each of said current drive circuits being controlled by one of a plurality of first control signals responsive to a plurality of first color signals obtained form an image to be displayed, each one of said current drive circuits driving a different one of said organic EL elements, each one of said current drive circuits comprising two current mirror circuits.

2. A drive circuit for an organic EL apparatus having a plurality of organic EL elements performing multicolor light emission, comprising a plurality of DC power supply circuits for each one of colors of emitted lights from said respective organic EL elements, wherein a voltage from one of said DC power supply circuits is applied to one of said organic EL elements emitting one of colors of lights, which is different from the voltage, applied to other organic EL elements emitting respective colored lights therefrom, wherein each of said DC power supply circuits is a DC-DC converter, further comprising a plurality of current drive circuits, one of said plurality of current drive circuits being connected to an output of one of said DC-DC converters so as to drive one of said EL elements, each of said current drive circuits being controlled by one of a plurality of first control signals responsive to a plurality of first color signals obtained from an image to be displayed, each one of said current drive circuits driving a different one of said organic EL elements, and further comprising a power supply voltage controller controlling said DC-DC converter in accordance with a second control signal indicating a differential voltage between an input voltage of said current drive circuit and an output voltage of said current drive circuit.

3. The drive circuit for an organic EL apparatus according to claim 2, wherein said power supply voltage controller comprises a first circuit for detecting differential potential between an output voltage of said DC-DC converter and an output voltage of said current drive circuit, and a second circuit for outputting said second control signal to said DC-DC converter in accordance with a voltage detected by said first circuit.

4. The drive circuit for an organic EL apparatus according to claim 2, wherein said power supply voltage controller comprises a first circuit for detecting differential potential between an output voltage of said DC-DC converter and an output voltage of said current drive circuit, and a second circuit for comparing said differential potential detected by said first circuit with a reference voltage, and a third circuit for outputting said second control signal to said DC-DC converter based on a comparison result of said second circuit.

* * * * *